US005101580A

United States Patent [19]

Lyden

[11] Patent Number: 5,101,580

[45] Date of Patent: Apr. 7, 1992

[54] PERSONALIZED FOOTBED, LAST, AND ANKLE SUPPORT

[76] Inventor: Robert M. Lyden, 2485 Edgerton St., Little Canada, Minn. 55117

[21] Appl. No.: 714,971

[22] Filed: Jun. 13, 1991

Related U.S. Application Data

[63] Continuation of Ser. No. 410,074, Sep. 20, 1989, abandoned.

[51] Int. Cl.[5] ..... A43B 13/18; A43B 13/38

[52] U.S. Cl. ..... 36/93; 36/88; 36/28; 36/43

[58] Field of Search ..... 36/88, 89, 28, 43, 69, 36/71, 44, 93

[56] References Cited

U.S. PATENT DOCUMENTS

| | | | |
|---|---|---|---|
| 2,123,730 | 6/1938 | Huttleston | 36/71 |
| 2,546,827 | 3/1951 | Lavinthal | 36/71 |
| 3,121,430 | 2/1964 | O'Reilly | 128/595 |
| 3,407,406 | 10/1968 | Werner | 2/3 |
| 3,685,176 | 8/1972 | Rudy | 36/71 |
| 3,716,930 | 2/1973 | Brahm | 36/3 B |
| 3,736,673 | 6/1973 | Dubner | 36/44 |
| 3,786,580 | 1/1974 | Dalebout | 36/117 X |
| 3,892,077 | 7/1975 | Wolstenholme | 36/43 |
| 3,968,577 | 7/1976 | Jackson | 36/28 |
| 3,985,853 | 10/1976 | Weisberg | 264/250 |
| 4,128,951 | 12/1978 | Tansill | 36/44 |
| 4,170,078 | 10/1979 | Moss | 36/44 X |
| 4,170,233 | 10/1979 | Bunsick | 36/44 X |
| 4,182,056 | 1/1980 | Dalebout | 36/71 X |
| 4,202,117 | 5/1980 | Bidegain | 36/71 |
| 4,211,019 | 7/1980 | McCafferty | 36/43 |
| 4,215,492 | 8/1980 | Sandmeier | 36/44 |
| 4,227,320 | 10/1980 | Borgeas | 36/44 X |
| 4,263,727 | 4/1981 | Bender et al. | 36/44 |
| 4,301,564 | 11/1981 | Dalebout | 36/117 |
| 4,408,402 | 10/1983 | Looney | 36/43 |
| 4,414,760 | 11/1983 | Faiella | 36/28 |
| 4,458,430 | 7/1984 | Peterson | 36/28 |
| 4,471,538 | 9/1984 | Pomeranz et al. | 36/43 |
| 4,472,890 | 9/1984 | Gilbert | 36/28 |
| 4,567,677 | 2/1986 | Zona | 36/28 |
| 4,577,417 | 3/1986 | Cole | 36/28 |
| 4,633,597 | 1/1987 | Shiang | 36/44 X |
| 4,662,087 | 5/1987 | Beuch | 36/93 X |
| 4,674,205 | 6/1987 | Anger | 36/44 |
| 4,674,206 | 6/1987 | Lyden | 36/88 |
| 4,700,403 | 10/1987 | Vacanti | 36/44 X |
| 4,724,627 | 2/1988 | Sisco | 36/71 X |
| 4,726,126 | 2/1988 | Bernhard | 36/89 |
| 4,744,157 | 5/1988 | Dubner | 36/88 |
| 4,768,295 | 9/1988 | Ito | 36/28 |
| 4,802,289 | 2/1989 | Guidager | 36/44 X |
| 4,821,430 | 4/1989 | Flemming et al. | 36/69 |
| 4,841,647 | 6/1989 | Turucz | 36/44 |
| 4,864,737 | 9/1989 | Marrello | 36/28 |
| 4,931,356 | 6/1990 | Misevich et al. | 36/44 X |
| 4,934,072 | 6/1990 | Frederickson | 36/28 X |

FOREIGN PATENT DOCUMENTS

| | | | |
|---|---|---|---|
| 0316289 | 5/1989 | European Pat. Off. | 36/88 |
| 2908019 | 9/1980 | Fed. Rep. of Germany | 36/43 |

*Primary Examiner*—Paul T. Sewell
*Assistant Examiner*—Ted Kavanaugh

[57] ABSTRACT

A personalized insert (20) containing a resilient material (41) is employed within an article of footwear (44) in order to enhance conformance, control, stability, support and comfort. The resilient material (41) is contained within a casing (22) of suitable configurations. Removal of restraining pin(s) (24), and/or the rupture of membrane(s) (62) isolating the reagents (27) then permits fluid communication and proper mixing of the resilient material (41). The resilient material (41) then sets in conformance with the wearer's foot (28) when the insert (20) is secured within an article of footwear (44). The invention permits accommodation to the wide range of foot (28) and arch )34) characteristics found amongst the general public and application within numerous types of footwear.

36 Claims, 4 Drawing Sheets

PERSONALIZED FOOTBED, LAST, AND ANKLE SUPPORT

This is a continuation of application Ser. No. 410,074, filed Sept. 20, 1989, abandoned.

Field of the Invention

This invention relates to foot and ankle supports which can be caused to conform to an individual's foot and/or ankles, or a portion or portions thereof. The present invention embodies advances in conception, design and materials with reference to U.S. Pat. No. 4,674,206 issued to the present inventor, Robert M. Lyden, on June 23, 1987.

BACKGROUND OF THE INVENTION

Many individuals, e.g., many athletes, possess debilitating podiatric conditions, thus require the fabrication of prescription orthotics. However, many of the problems commonly encountered simply stem from inadequate conformance, control, stability, support and comfort. Here, the last, midsole, and/or insole of the article of footwear often proves deficient. Every individual has a different set of feet. The problem to be solved: How to accommodate individual differences and thus provide superior conformance, control, stability, support and comfort within mass produced articles of footwear?

Heretofore, there have been a number of attempted solutions to this problem which have enjoyed varied success. Obvious merits aside, some of the deficiencies of the prior art will be briefly addressed. As mentioned above, orthotics are sometimes required to correct debilitating podiatric conditions. For some individuals, there is no other practical alternative. However, orthotics take considerable time for a specialist to fabricate and are thus relatively expensive. They are neither a viable practical alternative, nor truly necessary for the general public. Moreover, many orthotic devices are rigid and do not permit adequate flexion of the arch or arches. Orthotics are seldom fixed within the article of footwear in a manner that would prevent their slipping about. Such movement and dislocation produces discomfort for the wearer and partially nullifies the corrective value of the orthotic. Furthermore, the insertion of an orthotic device will often change the conforming properties of the last of the article of footwear resulting in poor fit and discomfort.

Pre-formed insoles of various kinds accommodate a greater, or lesser number of individuals depending upon the incorporation of characteristic norms with respect to their design. However, as every individual has a different set of feet, a pre-formed insole will not accommodate every individual to the same degree.

There have been a number of attempts to introduce deformable, or elastomeric materials into the area of the midsole, or insole of an article of footwear so as to provide a "custom" fit for any given individual. The present invention would fall into this category. Some of the prior art has proven inadequate because of improper design, or application. For example, reference is made to foot supports which contain elastomeric material(s) which underlie the entire foot. In the practical application, this can induce serious biomechanical complications. Reference is also made to attempts which have introduced such quantities of elastomeric material(s), as to alter the foot's proper conformance with the last of the article of footwear There have also been a number of ideas as to how to introduce and contain elastomeric material(s) within an article of footwear Many have thought to inject the material by various means, whereas others have thought to otherwise contain, or enclose the same. The procedures and methods associated with these attempts have for the most part been relatively complex, time consuming, expensive, or otherwise not amenable to mass production and use by the general public. In fact, it is believed that these shortcomings are responsible for the failure of the leading manufacturers of footwear to incorporate a personalized insert employing elastomeric material(s) within articles of footwear.

The same can be said with respect to attempts to stabilize the area of the ankles within articles of footwear. Some have thought to contain materials in solid, liquid, gaseous, or highly viscous form about the area of the ankles. Others have thought to inject like materials into this area by various means. In addition, some of these materials, e.g., various elastomers, have been injected in a liquid state, but then have set and cured into a solid. Skate and ski boot manufacturers have applied this technology with mixed results. However, the materials presently employed remain marginally suitable for these applications and the associated methods are relatively complex, time consuming, inconvenient, expensive, or otherwise not amenable to mass production and use by the general public.

Moreover, there have been relatively few successful attempts to introduce personalized lasts, heel counters, and/or ankle supports within articles of footwear. These attempts have likewise proven largely deficient or impractical. The present invention provides solutions to these and other problems

SUMMARY OF THE INVENTION

The present invention relates to a footwear insert construction for use or incorporation in an article of footwear. The insert construction provides superior conformance, control, stability, support and comfort within mass produced articles of footwear The ability to provide mass produced footwear makes the invention available for use by the general public.

The insert is personalized, custom fitted and is available to the general public. Those who do not require the fabrication of orthotics will be spared both time and expense. The insert is filled with a conformable material, preferably a resilient material as shown in preferred embodiments comprising a personalized insole. The resilient material preferably is less than 45 Shore A, thus permitting normal flexion of the arches. The preferred personalized insole preferably includes self-adhesive surface(s) that permit removal and replacement, but also prevent dislocation during use. The insole is made such that the ball of the foot and heel preferably rest upon a supporting surface within the article of footwear and the resilient material contained within the personalized insole is displaced from over the support surfaces such that supporting properties of the last of the article of footwear are substantially unaffected, thus avoiding poor fit or discomfort while the instep, or other regions requiring support are supported by the resilient (and conformable) material. The configuration of the preferred personalized insole is such that biomechanical complications often associated with the placement of elastomeric materials beneath the entire foot have been avoided. Preferably, an embodiment of the present footwear insert comprises a pliable casing forming a main body having an inner volume, an evacuation tube appendage connected to said main body, a resilient material contained within said main body and displacing some or all of said inner volume, wherein the evacuation tube appendage to the main body permits the displacement of an excess resilient material from the main body when the footwear insert is positioned within the article of footwear and when pressure is applied upon the insertion of a foot within the article of footwear.

In some applications, preferred personalized ankle insert(s) of suitable configuration can also be employed within an article of footwear in the area about the ankles to enhance control, stability, support and comfort. Moreover, suitable preferred embodiments of the present invention permit the introduction of personalized footbeds, lasts, heel counters, ankle supports and the like within articles of footwear. The personalized footbeds, lasts, heel counters and ankle supports accommodate the unique characteristics of any given individual's foot and ankle(s), or a portion or portions thereof. The procedures and methods associated with the use of various preferred embodiments of the present invention are few, simple, and take but a few minutes to execute, thus render use by the general public both possible and practical. Further objects and advantages of the invention will become apparent from a consideration of the drawings and ensuing description of it.

The above described features and advantages, along with various other advantages and features of novelty are pointed out with particularity in the claims of the present application which are attached hereto. However, for a better understanding of the invention, its advantages, and objects obtained by its use, reference should be made to the drawings which form a further part of the present application and to the accompanying descriptive material in which there is illustrated and described preferred embodiments of the present invention.

Figure 13:
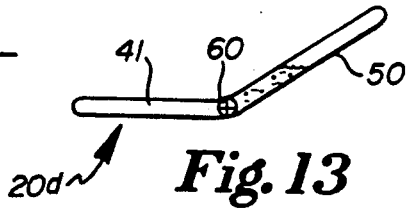
Figure 11:
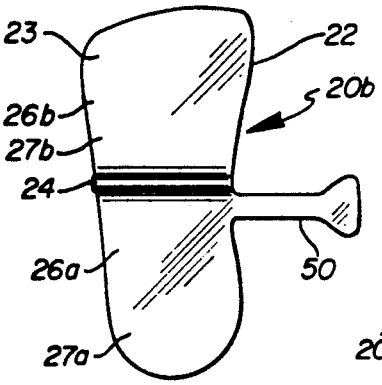
FIG. 11 is a top view of an alternate two compartment insert of the present invention which includes an evacuation tube to one compartment to permit the displacement of excess quantities of resilient material from the main body of the insert.
Figure 14:
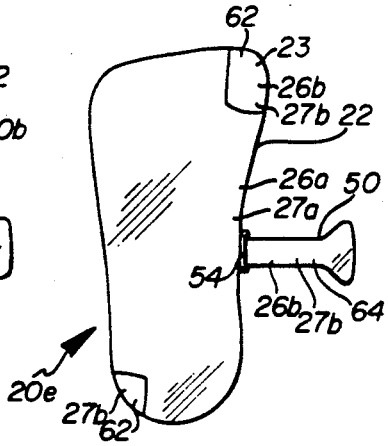
Figure 15:
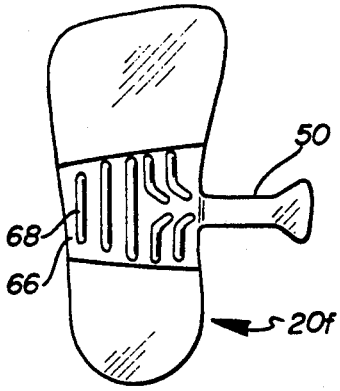
Figure 20:
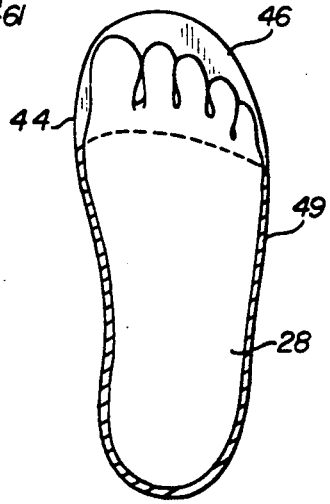
Figure 18:
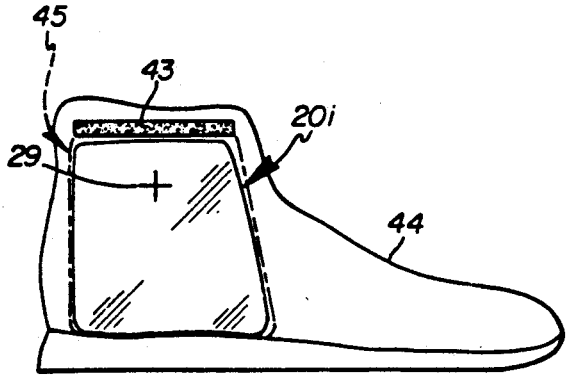
Figure 19:
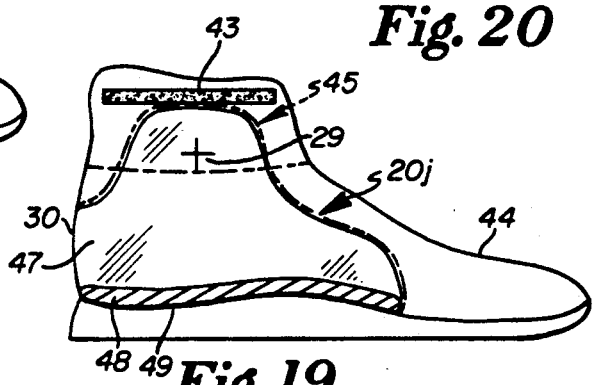
Figure 17:
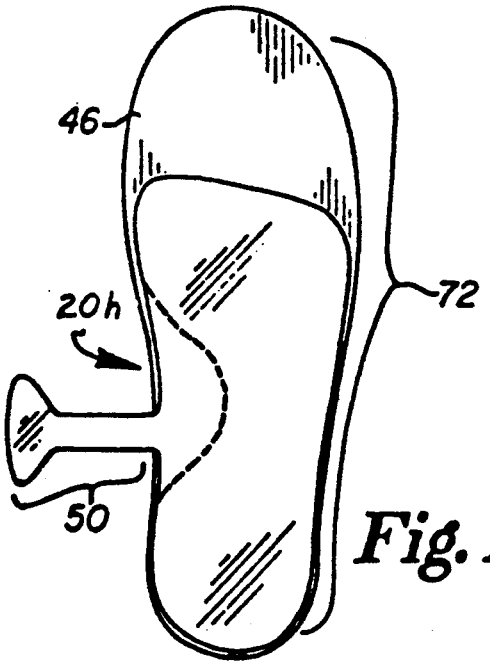
Figure 16:
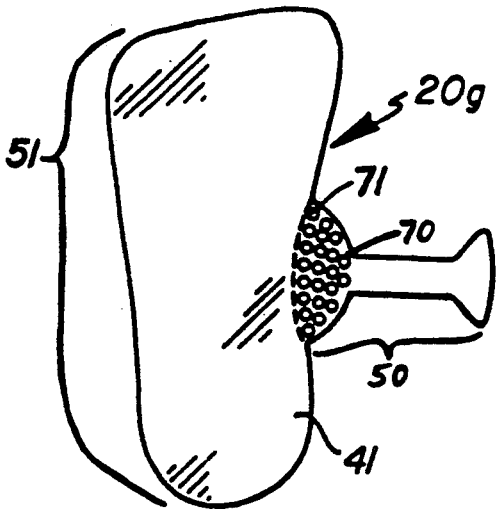

FIG. **12*a*** is a top view of a patch with a protective strip being removed to expose a self-adhesive surface on the patch for attachment to the insert after removal of the evacuation tube;

FIG. 13 is a side view of yet another alternate insert similar to that shown in FIG. 11 showing the use of a non-return or check valve to aid in the control of resilient material displaced into the evacuation tube with parts broken away to show the contents of the insert;

FIG. 14 is a top plan view of a modified insert of the present invention showing the evacuation tube used as a reservoir for initial isolation of one of the reagents or components used to form the filling material for the insert, as well as alternate use of one or more internal breakable enclosures affixed to the perimeter of the casing to permit the initial separation and later dispersion of one or more reagents or components within the insert;

FIG. 15 is a top plan view of a further modified insert of the present invention showing the use of pre-formed foam material within the insert and the presence of sculptured or raised contours thereon, thus permitting cross-flow, mixing and envelopment of the foam material by the catalyzed resilient material;

FIG. 16 is a top plan view of a further modified insert of the present invention showing the use of a preformed structural pattern or matrix to accommodate and direct the evacuation of resilient material in a manner to provide additional catalyzed conformability, control, stability, support and comfort; e.g., to the medial side of the foot;

FIG. 17 is a top plan view of a further modified insert of the present invention showing an overlaying insole liner affixed to the insert, thus forming a one-piece unit for placing into an article of footwear;

FIG. 18 is a side perspective view of an article of footwear having a modified insert of the present invention applied to the area about the ankle or ankles within the article of footwear;

FIG. 19 is a side view of an article of high top footwear having a modified form of the invention including a personalized footbed, last, heel counter and ankle support, employed within the article of footwear; and FIG. 20 is a top cross-sectional schematic view of the insert shown in FIG. 19 showing the personalized last within the article of footwear conformed about a foot.

DETAILED DESCRIPTION OF THE PREFERRED EMBODIMENTS

Figure 1:
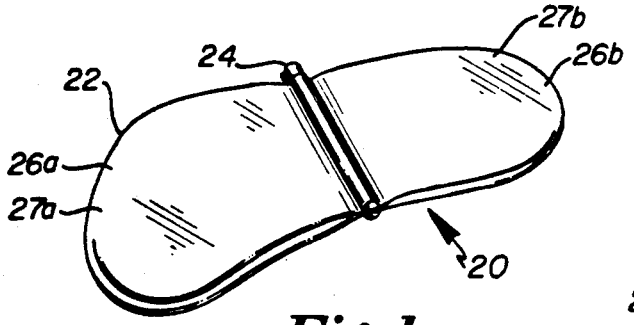
FIG. 1 is a perspective view of an insert of the present invention having separated compartments separated by a restraining pin and separates two reagents that catalyze to form an insert material.
Figure 5:
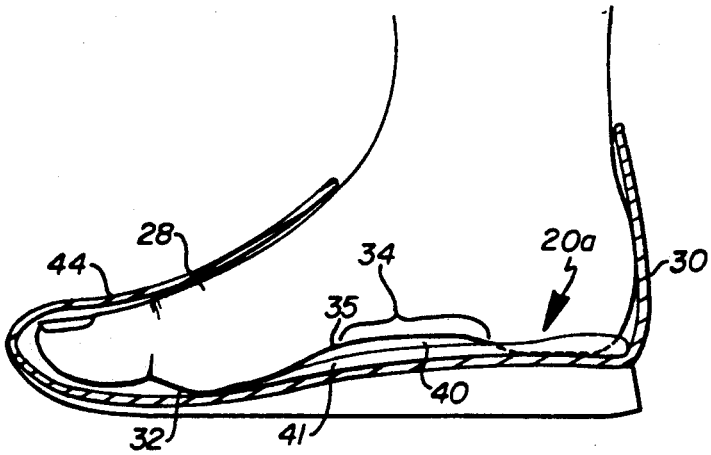
FIG. 5 is a side view of the insert of FIG. 3 installed in an article of footwear with a foot in position after the protective strip has been removed.

Referring to the figures, wherein like reference numerals represent like parts throughout the several views, a preferred insert 20 is shown in its original state in FIG. 1. The preferred insert 20 is composed of a substantially pliable, liquid impervious and transparent material, or casing 22, approximately 0.127–0.813 mm (0.005–0.032 inches) in thickness. The preferred casing 22 is then made from a material related to the group of thermoplastics, polymers, natural and synthetic rubbers consisting of silicones, urethanes, polyurethanes, polyesters, polyethylenes, polycarbonate, polyvinyl chloride, propylenes, polyamide, neoprene, styrenes, nylons, vinyls, nitrile, tyvec, TEFLON ®, TEDLAR ®, MYLAR ®, melamine, Melinex, HYPALON ®, butadiene acrylonitrile and styrene rubbers, latex, other natural and synthetic rubbers, and the like. The casing 22 forms a material containing a chamber or compartment and should be a durable material thus enabling the insert 20 to withstand the pressure of an individual's body weight being placed upon its solid, liquid, or gaseous contents As shown in FIG. 5, the portion of the preferred insert 20 containing resilient material(s) 41 substantially underlies the plantar side of the foot 28 and extends from the area about the heel 30 to an area adjacent, but short of the metatarsal heads 32, thus substantially supporting the arch(es) 34 of the foot 28. However, a full-length insert forming a chamber containing resilient material(s) 41 could be used in certain applications.

Ideally, the insert 20 should be designed in conformance with the last of the article of footwear 44 in which the application is to be made. The insert 20 would then vary as to both length and width depending upon the configuration and size of the particular application.

Various inserts for providing supports for ankles also are included as part of the invention. For example, as shown in FIG. 18, a modified alternate insert **20*i* is employed about the area 20 adjacent the ankle or ankles of a wearer in order to enhance control, stability, support, and comfort. Moreover, as shown in FIG. 19, another alternate embodiment of the comprising an insert 20*j* is employed within an article of footwear to provide a personalized, custom-fit footbed 48, last 49, heel counter 47, and in high-top articles of footwear as shown, support in the area 29 adjacent the ankle or ankles 29. Entrapped gas(es) 40 can also be introduced within the insert 20 in order to substantially reduce the weight of the material for the needed volume, aid in cushioning and support, aid in heat dissipation, serve as a blowing or foaming agent, or otherwise positively affect the course of chemical reaction(s) or the quality of the resilient material or. composition 41. The use of selectively permeable materials, e.g., permeability to various gases and water for the preferred casing 22 is anticipated in various embodiments of the present invention. The casing 22 is heat/pressure sealed or otherwise bonded or affixed at any mating edges using conventional techniques as to render the insert 20** a completely self-enclosed envelope type unit.

The interior compartment of insert 20 as shown in FIG. 1 is divided into two-parts **26*a* and 26*b*. A restraining pin 24 initially forms the two compartment and each is filled with a separate reagent 27*a*, 27*b* respectively. When the restraining pin 24 is removed the enclosures 26*a*, 26*b* are placed in fluid communication and the reagents 27*a*, 27*b* are then free to mix and interact within the interior chamber of insert 20**. The preferred low viscosity desired of the reagents facilitates their proper mixture, e.g., a viscosity of less than 200 poises. The preferred resilient material is formed by a two-part room temperature cure silicone, e.g., Dow Corning RTV 3110, or General Electric RTV 11, although other resilient materials are contemplated. The material is conformable before it is fully cured. For example, A preferred microcellular foam polyether urethane system with an approximate density in the range of 0.1 to 0.6 gram/cm$^3$ and suitable hardness could also be used. The preferred resilient material is thus made from a material or materials related to the group of thermoplastics, polymers, natural and synthetic rubbers comprising silicones, silicone gels, FLOLITE ®, urethanes, polyurethanes, polyethylenes, polycarbonate, polyvinyl chloride, propylenes, polyamide, neoprene, nitrile, vinyls, nylons, polyesters, epoxies, styrenes, butadiene acrylonitrile and styrene rubbers, latex, other natural and synthetic rubbers, and the like.

In the preferred embodiment, Dow Corning RTV 3110 is used with a filler that serves to further reduce the density and weight of the resilient material by volume. Organic microspheres manufactured by the KemaNord Company, Sweden, with product designation EXPANCEL constitute a suitable inert lightweight filler with a density in the range of 0.04 gram/cm$^3$, although other fillers are also useable. The preferred organic microspheres are durable and have elastic properties in addition to their low density, and thus render the resilient material softer after it has cured. Commercially available preferred organic microspheres are composed of PVDC/AN (polyvinylidene chloride/acrylonitrile), copolymer, carbon, phenolic materials and the like.

Inorganic microspheres having a low density could also be used these include, SCOTCHLIGHT GLASS BUBBLES, K1, density 0.20–0.30 grams/cm$^3$, manufactured by 3M Company, St. Paul, Minn. Commercially available inorganic microspheres are composed of soda lime borosilicate, sodium borosilicate, silica, aluminosilicate, fly ash, perlite, ceramics, and the like. In contrast with organic microspheres, inorganic microspheres do not possess substantial elastic properties and they thus to increase the overall hardness of the encapsulating resilient material or elastomer. For this reason it is necessary to use a softer resilient material or elastomer (in its initial state), in conjunction with inorganic microspheres when a specific range of overall resultant hardness is desired. Moreover, the inclusion of microspheres as a filler also tends to increase the viscosity of the reagent(s) in their liquid state and can make proper mixing of the reagents more difficult when pin 24 is removed. For this reason, Dow Corning 200, or other preferred thinning agents can be introduced to lower the viscosity of the reagent(s) in their liquid state and facilitate proper mixing of the reagents forming resilient material 41 within the insert 20. The use of thinning agents may-be desired regardless of the inclusion of preferred fillers and vice-versa. In some applications no thinning agents and no fillers are used with the resilient material 41. In other applications thinning agents may be used with or without fillers, and fillers may be used with or without thinning agents. Coloring agent(s) to indicate proper mixing of the reagents and resilient material 41 also can be used.

Further with regard to the preferred two-part resilient material, the setting time of the reagents and hardness of the resultant resilient material 41 should be selected according to certain criteria. A working time of 5–15 minutes at room temperature is sufficient for the completion of necessary conforming, fitting procedures as described below. The working time can be specifically regulated by proper selection(s) regarding the type(s), amount(s) and concentration(s) of the catalyst(s) used for the elastomer or resilient material. In some preferred embodiments and applications, it may be desirable to use so-called "retarding" or "accelerating" co-catalysts or agents with the primary catalyst for forming the elastomer or resilient material.

The preferred alternate embodiment shown in FIG. 14 has an evacuation tube structure 50, and/or single, or multiple internal breakable enclosures 62 affixed to the perimeter 23 of the casing 22 openable to the interior chamber of the casing which can be utilized to accommodate and initially separate various reagents or materials. It can be readily understood that a multiplicity of restraining pins 24, breakable enclosures 62 could be employed with modified embodiments of the present invention. Moreover, these structures can be used separately, or in combination. Separation of various reagents or materials can help promote chemical stability, thus product integrity and shelf life. Multiple sites for reagent, e.g., catalyst dispersion, can also aid in proper mixing of the reagents.

Figure 6:
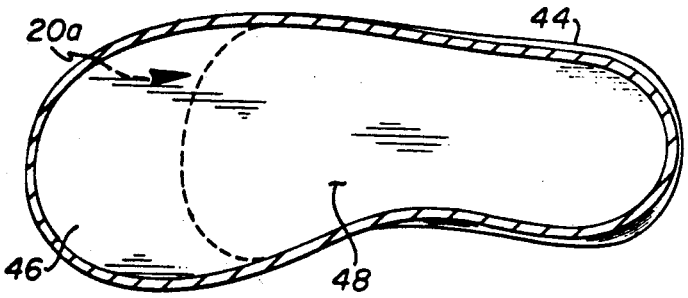
FIG. 6 is a top view of the insert of FIG. 3 in phantom under the overlaying insole liner of FIG. 4 when installed in an article of footwear.

The preferred resilient material 41 when cured has a hardness corresponding to the range of hardness found in the midsole material(s) being used by the leading manufacturers of athletic shoes. This is normally in the range of 10–60 Shore A. (Note, for example, Dow Corning RTV 3110 has a hardness of 45 Shore A, and the use of organic microspheres as a filler and/or thinning agents further reduces the hardness of the cured resilient material.) Thus, the resilient material 41 acts to absorb shock while substantially conforming to the shape of and stabilizing the wearer's foot 28 within an article of footwear 44 as shown in FIGS. 18 and 19. The preferred hardness and elastic properties of the resilient material 41 used in various alternate embodiments of insert 20 can be suitably modified for particular application. One application is a personalized insole, or insert 20*a* used in the area of the footbed 48 as shown in FIG. 6 such an insole would use a resilient material that would cure to a hardness of 15–35 Shore A. A personalized insert 20*i* used in the region 29 of the ankle(s) as shown in FIG. 18 could employ a resilient material that would cure to a hardness of 25–60 Shore A. In FIG. 19*a* personalized insert 20*j* which encompasses the footbed 48, last 49, heel counter 47, and in high-top articles of footwear the region 29 of the ankle is shown. Such an insert could employ one or more chambers (not shown) containing different reagents for forming materials 41 which would cure to various preferred consistencies, for example, the area of the footbed 48 could cure to 15–35 Shore A; the area of the last 49 and heel counter 47 could cure to 45–90 Shore A; and the area of the ankle 29 could cure to 25–60 Shore A. Obviously, an additional preferred embodiment (not shown) could include the application of one or more personalized insert(s) 20 which can be caused to conform to an individual's foot and/or ankle(s), or a portion or portions thereof for use within articles of footwear.

An additional reason why a two-part, room temperature cure silicone is preferred as the resilient material is the absence of a noticeable exothermic reaction. However, it should be noted, that the personalized insole or insert 20 preferably underlies the insole liner 46 (FIG. 20), which would then serve to insulate the wearer's foot 28 from any possible exotherm as the resilient material 41 sets and cures. In addition, there are no known significant health risks, or toxicity associated with the use of Dow Corning RTV 3110 and other like silicones, in contrast, e.g., with many urethane and polyurethane materials.

Another material that can be employed within the preferred personalized insole, footbed, last, heel counter and ankle support applications of insert 20 is an entrapped gas or gases. The quantity of the reagents 27*a*, 27*b* and entrapped gas(es) introduced within compartment parts 26*a*, 26*b* can be regulated during production. Any entrapped gas(es) tend to naturally rise to the highest point(s) within the compartment of insert 20. In the insert 20*a* shown in FIG. 5 this will normally correspond to the area about the apex 35 of the arch(es) 34 once the reagents in insert 20*a* are activated, inserted into an article of footwear 44 and conformed to the wearer's foot 28. As shown in FIG. 5, the entrapped gas(es) or "air cushion" 40 within the preferred insert 20*a* can then help to accommodate the dynamic flexion of the area of the arch(es) 34 in the precise area where such movement occurs. It could be desirable to introduce reinforced, or specially designed chamber(s) (not shown) within preferred embodiments of the present invention to ensure proper containment of entrapped gas(es). In addition, the inclusion of preferred entrapped gas(es) can serve to reduce the weight of the insert 20 of a given volume, aid in support and cushioning, aid in heat dissipation, serve as a foaming or blowing agent, or otherwise positively affect the course of the chemical reaction(s) and quality of the resilient material.

In any of the embodiments of the present invention, different individuals will displace different volumes of the resilient material 41 in attaining proper conformance of shape. This is due to the great variation in foot structure and form which exists amongst the general public. It should be noted that in suitable embodiments of the present invention the protruding contours on the plantar side of the foot, e.g., the heel and ball of the foot are supported by a preferred insert 20 after it is affixed upon the board-lasted or slip-lasted footbed, or (mid)-sole of the article of footwear. The wearer's foot "bottoms out" and is supported in the article of footwear 44 (FIG. 5) without having the activated resilient material 41 within the insert 20 under the heel or ball of the foot. As shown in FIG. 5, the insert 20*a* serves to fill the voids between the foot 28 and the supporting surface(s) within the article of footwear 44 in the arch area in particular and forms around the plantar side of the foot 28 from the area adjacent, the heel 30 to an area about, but short of the metatarsal heads 32, but without changing the geometry of the foot 28 in relation to the last 49 of the article of footwear 44.

As shown in FIG. 16, an alternate insert 20*g* can be suitably configured to additionally stabilize, the medial or lateral sides of the foot 28. As shown in FIG. 18, the alternate insert 20*i* can be suitably configured and applied in the area about the ankle or ankles 29 to enhance stability, support, control and comfort. Moreover, as shown in FIG. 19, an alternate insert 20*j* can be suitably configured and applied to provide a personalized footbed 48, last 49, heel counter 47, and in high-top articles of footwear, support to the area about the ankle or ankles as shown at region 29. The desired practical effect is to properly support and stabilize the foot 28 in the neutral position in association with an article of footwear 44. The preferred use of a silicone elastomer derived from silica or sand, can then be understood as returning the foot to something resembling the natural environment wherein its structure and function evolved, i.e., continuous contact, support and plantar encapsulation upon an accommodative surface. This desired state is commonly lost when an article of footwear 44 with inadequate conforming properties is donned and worn on a hard, flat surface such as asphalt or cement.

The amount of resilient material 41 present within an insert 20 intended for any given application can be regulated during production so as to accommodate for differing arch characteristics, and associated requisite volumes, e.g., high, normal and low arches or so-called flat feet. The use of preferred foaming or blowing agent(s) with the preferred resilient material would constitute an alternate method to accommodate varying arch characteristics, as different volumes can then be displaced by a given quantity of the foamed or blown resilient material. Preferred foaming or blowing agents would also serve to reduce the density of the resilient material and thus lower its weight for a given volume. Such are generally classified as physical or chemical blowing agents. Physical agents function as gas sources by undergoing a change in a phase state. Suitable physical blowing agents are largely related to the group of aliphatic hydrocarbons and their chloro- and fluoro-derivatives comprising; isomers of pentane, hexane, heptane, fluorocarbons, trichlorofluoromethane, dichlorodifluoromethane, dichlorotetrafluoromethane, methylene chloride, and the like. Chemical blowing agents produce gas by a chemical reaction. Suitable chemical blowing agents are largely related to the group comprising sodium bicarbonate, dinitrosopentamethylenetetramine, sulfonyl hydrazides, azodicarbonamide, p-toluenesulfonyl semicarbazide, 5-phenyltetrazole, diisopropylhydrazodicarboxylate, sodium borohydrite, and the like. The thermal range of decomposition of many preferred commercial blowing agents can be lowered by the addition of activators or kickers. Moreover, it should be noted that the presence of ordinary water serves as a foaming or blowing agent for many resilient materials, e.g., urethanes, and polyurethanes.

A preferred structure for accommodating varying arch shapes or characteristics, and associated volumes and quantities of the resilient material within an insert **20*b* is shown in FIG. 11. An evacuation tube 50 comprises an integral part of the casing 22 which forms an interior chamber and is initially isolated from the resilient material 41 within the insert 20*b* by at least one of the devices shown in FIG. 12 in series. These include a plastic lock 52, commonly known as a ziplock fastener, a control pin or clip 54, or a clamp 56 which has a key head on it, to form a control key. These devices will prevent movement of material from the main body 51 of insert 20*c* into the evacuation tube 50 until manipulated or removed to open the passageway to the evacuation tube 50. The devices 52, 54 and 56 closing the evacuation tube 50 are removed after the resilient material 41 within the preferred insert 20*c*** has been properly mixed.

When the insert such as **20*b* or 20*c* is placed into an article of footwear 44 and the foot 28 is inserted and properly secured, the excess resilient material 41 is displaced and moves into the evacuation tube 50. A fixed quantity of the preferred resilient material 41, or a volume of one or more useable solid, liquid, or gas or combinations thereof which is known to be the largest volume required for an individual with that particular foot size can then be inserted within the chamber in insert 20*b* during production. The evacuation tube 50 will permit the displacement and removal of any excess quantities of the resilient or other fill material, and thus serve to accommodate all those individuals who would require lesser volumes. The evacuation tube 50 and its filling of excess resilient material is then excised with a scissors or other tool and removed from the main body 51 of the insert 20*b* after the resilient material has cured and will no longer leak out. The evacuation tube 50** and excess resilient material can then simply be discarded.

Figure 12:
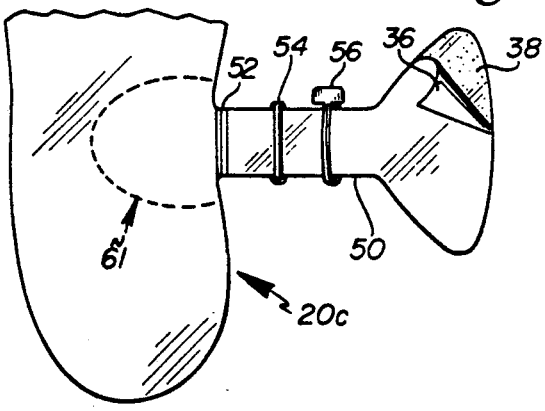
FIG. 12 is a top view of a portion of another alternate insert similar to that shown in FIG. 11 showing devices which can be used independently or in combination to initially isolate, and subsequently control displacement of the resilient material into, the evacuation tube, and with a protective strip being removed to expose a self-adhesive surface on the evacuation tube.

As shown in FIG. 12, a preferred embodiment of insert **20*e* can use "ziplock" 52, control pin or clip 54, and control key 56 devices independently, or in series combination to restrict or control access of the resilient material with respect to the evacuation tube 50. The evacuation tube can have a self-adhesive surface 38 covered with a peel-away protective backing 36 to facilitate control of the evacuation tube's 50** inner volume.

In addition, the possible employment of non-return or check valve(s) 60 to control displacement of the resilient material 41 from the main body 51 of the employment of single or multiple breakable enclosures 62 within the main body 51 of the insert **20*e* is shown in FIG. 14. The use of the evacuation tube 50 as a reservoir 64 for one of the reagents, e.g., a catalyst, prior to release, fluid communication and mixing of the reagents is also shown in the preferred embodiment of insert 20*e* in FIG. 14 where the numerals 26*b* and 27*b* indicate a separated reagent chamber isolated by a pin or clip 54**.

Again, it can be readily understood that single or multiple internal breakable enclosures 62 affixed along the perimeter 23 of the insert **20*c*, as shown in FIG. 14, whether used independently, or in combination with one or more flow control pin(s) 24 or other mechanisms and/or with the evacuation tube 50 used as a reservoir 64 for one reagent, could be used in alternate embodiments of the present invention. These alternate embodiments can have inserts or separate chambers used to further separate various reagents or materials, e.g., catalytic accelerators or reducers, in order to enhance product stability and shelf life, or would otherwise be required with the possible use of multi-part resilient materials. The use of multiple sites for initial storage of the reagent(s) or catalyst(s) can also facilitate proper mixing of the resilient material 44**.

In FIG. 15 the use of a preferred preformed piece of foam material 66 within the main body 51 forming the insert chamber is shown in an insert **20*f*. The foam material will reduce the overall density and weight for a given volume of the insert material. The foam material 66 is a material or materials related from the group of open and closed cell foams comprising silicones, urethanes, polyurethanes (micro-cellular, ester, ether, reticulated), polyamide, melamine, polyethylene (linear, cross-linked), neoprene, nitrile, natural or synthetic rubbers, polyvinyl chloride, and the like. The preferred foam material 66 can be surfaced as self-skin, embossed, laminated with a fabric, or coated with a thermoplastic or polymer film related from the group comprising silicones, urethanes, polyurethanes, polyethylenes (plain, antistatic, or conductive), vinyls, melinex, tyvec hypalon, polycarbonate, MYLAR®, TEDLAR®, latex, other natural or synthetic rubbers, and the like. A relatively smooth-skinned or closed cell foam material is preferred for insert 66, as such materials maintain low density by preventing the penetration or absorption of the liquid reagent(s) 27 or resilient material 41 within the foam material 66. Smooth surfaces on the form insert 66 facilitate cross-flow and proper mixing if the reagents used and, envelopment and encapsulation of the foam material 66 by the resilient material 41**.

The foam material piece 66 can be molded or heat/-pressure sculptured to provide raised contours 68 of predetermined configurations. The preferred foam material 66 can then be so configured to aid in conformability, facilitate cross-flow and proper mixing of the resilient material 41, permit envelopment and encapsulation of the preferred foam material 66 by the resilient material 41, and direct removal or out flow of excess quantities of the resilient material 41 from the main body 51 of the insert 20*f* (FIG. 15) into the evacuation tube 50. In addition, a silicone gel, e.g., Dow Corning SYLGARD 527, and the like, can be selectively utilized with the foam material 66 in a predetermined structural pattern or matrix (not shown) to provide for specific properties of compression and elasticity at various points within the insert 20*f*. Other viscous or visco-elastic materials, e.g., FLOLITE ®, or solids, liquids,.or gas(es) could be utilized for the same purpose within various alternate embodiments of insert 20. Raised contours 68 along the surface(s) of the foam material piece 66 facilitate mixing of the reagents and permit the resilient material 41 to fully envelop the foam material 66 within the insert 20*f* so that upon curing, the foam material 66 is "entrapped" and encapsulated by the resilient material 41, thus causing the impression or shape molded in conformance with the foot 28 to be retained.

In FIG. 16 the use of a pre-formed structure or matrix pattern 70 within, or alternatively, one formed as an integral part of the casing 22 of the insert 20*g* is shown. The matrix pattern 70 will selectively direct evacuation of the displaced resilient material 41 and thereby enhance support and stability with respect to the medial side of the foot 28 in particular and could be likewise incorporated in the area about the ankles in high-top articles of footwear.

Figure 3:
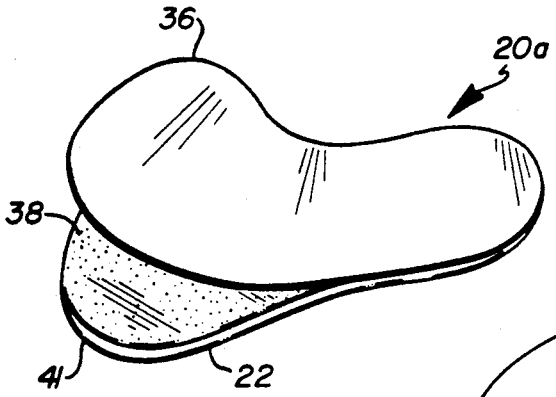
FIG. 3 is a perspective view of the insert of FIG. 2 showing the removal of a protective strip on the underside of the insert exposing a self-adhesive surface.
Figure 4:
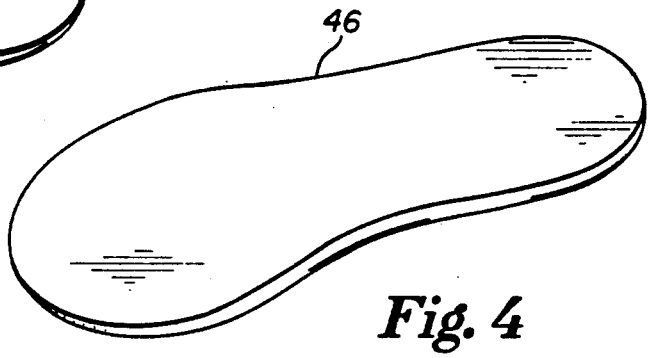
FIG. 4 is a perspective view of an insole liner for use with embodiments of the present invention.

In FIG. 17 an overlaying insole liner 46 is used as the upper structural wall of the insert 20*h* or the casing 22 can alternatively be heat/pressure sealed, bonded, or otherwise affixed to the insole liner 46 so as to create a one-piece unit 72 of the insert 20*h* and insole liner 46 as shown in FIG. 17. One side (shown), or both sides (not shown) of the preferred insert 20*a* can employ peel-away protective backing(s) 36 that expose self-adhesive surface(s) 38 as shown in FIG. 3. The preferred adhesive being used at the present time is a "pressure sensitive" product that permits removal and replacement of the preferred insert 20 if ever necessary: SCOTCH-MOUNT ®double coated foam adhesive tapes manufactured by 3M Company, St. Paul, Minn., are being used at the present time, although other materials are contemplated. The preferred product is 3M tape No. 4484, a white polyethylene foam tape with a thickness approximately of 1/16th or 0.063 inches. Suitable materials and products must have a temperature resistance meeting or exceeding approximately 100–120 degrees Fahrenheit, demonstrate resistance to solvents, in particular water, and have high adhesive qualities. A foam tape with a thickness approximately of 0.031–0.063 is preferred for the bottom side of the preferred insert 20 in most embodiments in order to accommodate for irregularities between the surfaces to be joined. In some applications, a preferred thinner double-coated adhesive tape can be used to affix the upper surface of the area of the footbed 48 of the preferred insert 20 to the bottom side of the insole liner 46.

Figure 7:
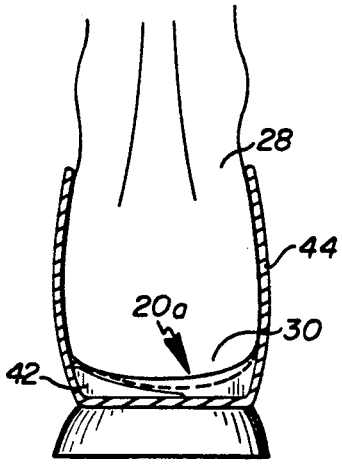
FIG. 7 is a rear view of a corrective post or wedge with the footwear in section being used in conjunction with the insert of FIG. 5.
Figure 8:
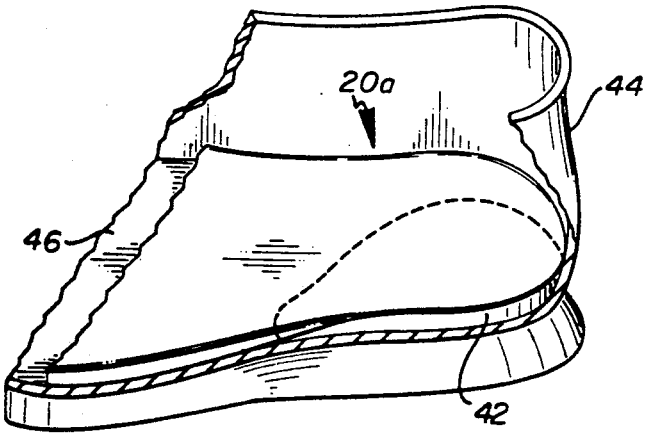
FIG. 8 is a side perspective view of the corrective post or wedge of FIG. 7 being used in conjunction with the insert of FIG. 5.

Referring to FIG. 7 and FIG. 8, it is also possible to introduce corrective posts or "wedges" 42 in conjunction with a preferred insert 20 in order to rectify podiatric deviations that would fall outside the norm, e.g., potential and actual injurious conditions of pronation, supination, varus, and valgus. These posts or "wedges" 42 can be manufactured to specified degrees of correction for the article of footwear 44 in which the application would be made. Again, preferred protective backing(s) can be removed from the posts or "wedges" 42 to expose self-adhesive surface for securing the ports on wedges 40 in place. The introduction of such corrective devices should only be undertaken at the direction and with the supervision of a skilled and knowledgeable podiatrist or other medical doctor.

For the sake of clarity, the disclosure of various alternate embodiments and features thereof in the drawings and written description of the present invention has largely treated these embodiments and features thereof independently, e.g., the possible use of restraining pin(s) 24, breakable inner enclosures 62 affixed to the perimeter 23 of the casing(s) 22, self-adhesive surface(s) 38, evacuation tube(s) 50, posts or "wedges" 42, insole liner(s) 46, check valve(s) 60, foam material(s) 66, structural matrix pattern(s) 70, and so on, have not been shown with respect to the preferred embodiments of insert 20*i* and insert 20*j* in FIGS. 18–20. However, it can be readily understood that alternate embodiments of the personalized insert 20 for use within articles of footwear could include various combinations of the embodiments in separate inserts and a multiplicity of the features described in such inserts.

Figure 2:
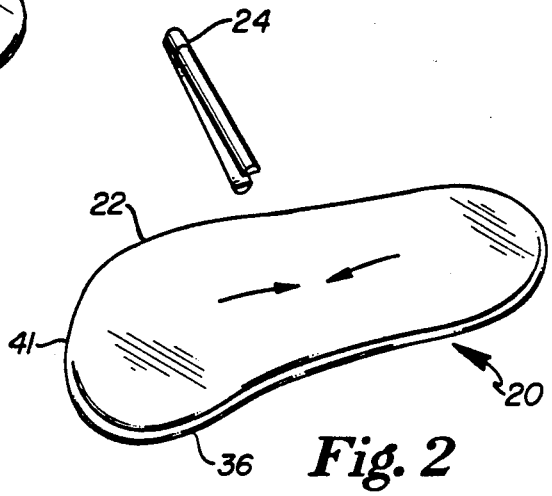
FIG. 2 is a perspective view of the insert of FIG. 1 after removal of the restraining pin and mixing of the two reagents.

The procedure for employing the preferred personalized insole, or insert 20 can now be described with reference to the figures. When applying the present invention in the embodiment shown in FIG. 2, the restraining pin 24 is removed to permit the reagents 27*a*, 27*b* in enclosures 26*a*, 26*b* to mix freely. The insert 20 is then manually kneaded as necessary. Mixing is easily accomplished because of the relative low viscosity of the preferred reagents 27*a*, 27*b* and can be verified visually with the assistance of coloring agents. The protective strip(s) 36 can then be removed from the casing 22, thus exposing its self-adhesive surface(s) 38. The activated insert 20*a* is then placed into the article of footwear 44. When an insole liner 46 is not affixed to the insert 20*h* (as shown in FIG. 17): The insole liner 46 is then be inserted into the article of footwear 44. Most desirable is a flat, uncontoured liner or insole, e.g., of SPENCO ®, but other materials are acceptable provided that they would assume proper continuity and conformance when the insert 20*a* is molded by insertion of the foot 28 into the article of footwear 44. The foot 28 is then inserted and secured within the article of footwear 44 and the material 41 will mold around the foot.

When the evacuation tube 50 is being used as a reservoir 64 for one of the reagents 64, e.g., the catalyst, as shown in FIG. 14, the procedures governing activization or catalyzation of the preferred insert 20*e* and mixing are the same as those described above. In addition, when one or multiple internal breakable enclosure(s) 62 affixed to the perimeter 23 of the casing 22 are being used for reservoirs of one of the reagents or the catalyst(s), as shown in FIG. 14, the enclosure(s) 62 should be ruptured thus enabling the reagents to be placed in fluid communication within the insert 20*e* and to be properly mixed. The remaining procedures in this case are the same as those described above..

When the insert 20 employs an evacuation tube 50 as shown in FIGS. 11–17 in each instance, the restraining pin(s) 24, and/or breakable enclosure(s) 62 should be suitably manipulated, as discussed above, to activate or catalyze the preferred insert 20 by permitting communication and proper mixing of the preferred reagents. Ziplock 52, control pin or clip 54, control key 56, or other restraints or actuators regulating access of the resilient material 41 to the evacuation tube 50 as shown in FIG. 12 should then be suitably manipulated to open the evacuation tube 50 to the chamber of insert 20. The insert 20 with the evacuation tube 50 attached should then be placed into the article of footwear 44 without exposing its bottom-side self-adhesive surface 38. When the insert does not have an overlaying insole liner 46 affixed to it to create a one-piece unit 72 as shown in FIG. 17, the additional operation of inserting the insole liner 46 then follows and immediately precedes placement of the foot 28 into the article of footwear 44. The foot 28 is then inserted into the article of footwear 44 and the resilient material 41 permitted to set with relevant body parts held in the neutral position as described below and shown in FIGS. 9 and 10. The next operation is to then remove the preferred insert 20, as shown in FIGS. 11–17, and excise the evacuation tube 50. The evacuation tube 50 will contain displaced excess resilient material 41 which can then simply be discarded.

Figure 12A:
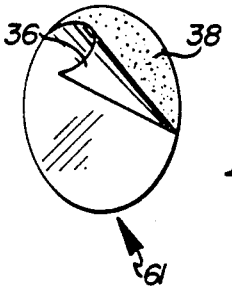

A self-adhesive patch 61 can then be applied to close the opening in the casing 22 created by removal of the evacuation tube 50 as shown in FIG. 12*a*. The self-adhesive surface 38 on the bottom of the insert 20*a*, as shown in FIG. 3, should then be exposed by removing its peel-off protective backing 36 and the insert 20*a* is then affixed within the article of footwear 44. It can be readily understood that alternate embodiments of the personalized insert 20 could then include various combinations and/or multiplicity of the features disclosed above and the required procedures corresponding to their application.

In addition, as shown in FIG. 18, a preferred insert 20*i* of suitable configurations can be suitably positioned within an article of footwear 44 during manufacture and later be activated as discussed above, or alternatively be later inserted into a preferred compartment or pocket 45 within an article of footwear 44 by opening an access point 43 which may be secured by Velcro ® fasteners. The access point 43 is then secured and the foot 28 inserted and secured within the article of footwear 44. The resilient material 41 then sets and cures or otherwise conforms with the area about the ankle or ankles 29 of the foot 28.

Moreover, as shown in FIG. 19, an insert 20*j* of suitable configurations can be inserted or otherwise positioned within an article of footwear 44. The insert 20*j* can then be activated as described above, the foot 28 inserted and secured, and the resilient material 41 then permitted to set and cure, or otherwise conform to the foot 28 within the article of footwear 44. As shown in FIGS. 19 and 20, it is thereby possible with the use of insert 20*j* to substantially personalize the insole 46, footbed 48, last 49, heel counter 47, and in high-top articles of footwear the area about the ankles 29.

As discussed above, the preferred insert 20*j* used in this embodiment can employ a single chamber, or a multiplicity of chambers containing a single, or a multiplicity of resilient material(s) 41, whether solid(s), liquid(s), or gas(es), and whether used independently or in combination, which when cured possess uniform, or different properties of elasticity and hardness within various chambers.

Figure 9:
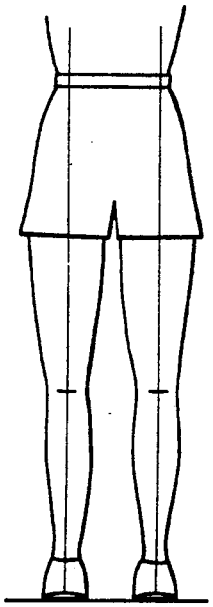
FIG. 9 is a front view of an individual showing proper bodily alignment in a standing neutral position.
Figure 10:
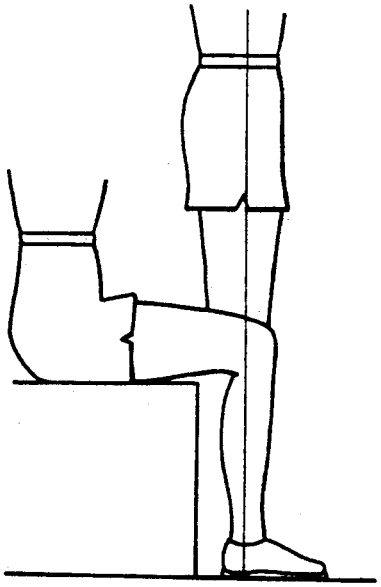
FIG. 10 is a side view of an individual demonstrating proper bodily alignment in standing and sitting neutral positions.

In all applications of the preferred embodiment, it is important that the wearer stand, or sit relatively motionless as the activated preferred insert 20 sets or cures. Under normal conditions at room temperature, this will preferably occur between 5–15 minutes after the preferred reagents 27 have been properly mixed. Allowing for a preferred working time of 5–15 minutes, then an additional 5–15 minutes set or cure time, yields approximately 10–30 minutes duration from start to finish. For preferred resilient materials 41 in athletic applications the inventor considers that the insert 20 should set with the wearer maintaining a standing position in order to better accommodate for the flexion of the arch(es) 34 and deformation of the foot 28. Whether the preferred insert 20 is molded and set in a standing or sitting position, the alignment of the wearer's leg and foot should preferably correspond to the neutral position, i.e., the lower leg (tibia) should be roughly perpendicular to the surface upon which the article of footwear rests. The knee joint should be in the same vertical plane(s) as the ankle joint and its alignment with respect to the foot should be such that the knee (patella) is roughly in line with the middle of the fore-foot. The conditions of pronation or supination will thus be avoided. FIGS. 9 and 10 illustrate preferred standing and sitting neutral positions.

As noted above, it would be possible to correct podiatric conditions by introducing pre-formed posts or "wedges" 42, or other devices incorporating the necessary correction in conjunction with the insert 20*a* as shown in FIGS. 7 and 8. These can be suitably affixed to the underside of the insert 20*a* prior to its insertion into an article of footwear 44. It can be readily understood that the introduction of pre-formed posts or "wedges" 42, or other devices would be possible with various preferred embodiments of insert 20. Again, the introduction of such corrective devices should only be undertaken at the direction and with the supervision of a skilled and knowledgeable medical doctor.

It will be appreciated that application of the personalized insert 20 provides a relatively simple, but effective practical method for enhancing the conformance, control, stability, support and comfort afforded by articles of footwear. In addition, the various preferred embodiments and features described above anticipate a wide range of possible applications and the need to accommodate individual differences across the broad spectrum of the general public. The invention, e.g., can be applied within articles of footwear in the work shoe and work boot industry, hockey skates, basketball shoes, in-line and conventional roller skates, skis, and athletic footwear of all kinds. Moreover, the scope of the present invention's application truly extends to all manner of footwear, e.g., mens and womens casual and fashion footwear (high heeled shoes being notorious for inadequate support). Certain properties and qualities of preferred silicone materials (e.g., thermal range and electrical tolerances, inert and non-toxic nature), could also render the invention desirable for application in the aero-space and space industry.

It is to be understood that the intended features shown in Figures at 20*a* –20*j* may be combined as desired for use. That is, one or more features may be combined with each other feature or all features to form a suitable insert 20, at the selection of the user.

While the above detailed description of the invention contains many specifications, these should not be construed as limitations on the scope of the invention, but rather as exemplifications of several preferred embodiments thereof. Many other variations are possible. For example, the shape of the preferred insert, casing, evacuation tube and the content of the preferred insert can vary from application to application depending upon the circumstantial demands and the preferred embodiment most likely to provide optimal performance. Accordingly, the scope of the invention should be determined not by the embodiment(s) discussed or illustrated, but by the appended claims and their legal equivalents.

What is claimed is:

1. A footwear insert for use in an article of footwear and conforming to and supporting a portion of a wearer's anatomy and attenuating force applications and shock comprising a pliable casing forming a chamber having an appendage, each having inner volume, said chamber containing mixable reagents and a foam material comprising solid matter having select form and generally conforming to said portion of said wearer's anatomy, said appendage forming a reservoir, a first restraint for selectively isolating said reservoir of said appendage from said chamber, and a second restraint for selectively separating said reservoir into two portions thereby selectively separating mixable reagents which can be made to mix to form a conformable material substantially comprised of fluid matter when said second restraint is removed, when said first restraint for selectively isolating said reservoir of said appendage is removed fluid communication and movement of said conformable material between said reservoir of said appendage and said chamber is permitted and said conformable material can at least partially encapsulate said foam material within said chamber, said conformable material subsequently forming a resilient material substantially comprising solid matter after a working time, said footwear insert thereby exhibiting different select mechanical properties as between at least two portions thereof as the result of the coordinated and select use of said foam material and said resilient material, said footwear insert substantially retaining the shape imparted by said portion of said wearer's anatomy when said conformable material substantially comprises said resilient material.

2. The footwear insert according to claim 1, wherein said portion of said wearer's anatomy comprises said wearer's foot.

3. The footwear insert according to claim 2, wherein said foot has a heel, arches, and metatarsal heads, and said footwear insert at least partially underlies the arches and extends from an area about the heel to an area rearward of the metatarsal heads.

4. The footwear insert according to claim 1, wherein said portion of said wearer's anatomy comprises said wearer's mellaolus.

5. The footwear insert according to claim 1, wherein said portion of said wearer's anatomy comprises said wearer's lower leg.

6. The footwear insert according to claim 1, wherein said first restraint for selectively isolating said reservoir of said appendage comprises a removable clamping mechanism positioned on said appendage.

7. The footwear insert according to claim 1, wherein said second restraint for selectively isolating said reservoir comprises a breakable enclosure.

8. The footwear insert according to claim 1, whereins aid foam material is made from a material selected from the group of open and closed call foams consisting of silicones, urethanes, micro-cellular, ester, ether, and reticulated polyurethanes, polyvinyl chloride, polyamide, melamine, linear, and cross-linked polyethylene, latex, neoprene, nitrile, other natural and synthetic rubbers.

9. The footwear insert according to claim 1, wherein a silicone gel material is used in communication with said foam material.

10. The footwear insert according to claim 1, wherein said pliable casing is configured to selectively direct placement of said conformable material within said footwear insert before said conformable material forms said resilient material substantially comprising solid matter after a working time.

11. The footwear insert according to claim 1, comprising at least one opening through said footwear insert for the passage of matter in isolation from the inner volume of said footwear insert.

12. The footwear insert according to claim 1, wherein said pliable casing comprises at least one material.

13. The footwear insert according to claim 12, wherein said pliable casing at least partially comprises a textile material.

14. The footwear insert according to claim 1, wherein said conformable material includes a filler material and comprises said resilient material after a working time.

15. The footwear insert according to claim 14, wherein said filler material is comprised or microspheres related from the group of microspheres consisting of polyvinylidene chloride, acrylonitrile copolymer, carbon, phenolic materials, soda lime borosilicets, sodium brosilicate, silica, aluminosilicate, fly ash, parlite, and ceramics.

16. The footwear insert according to claim 1, wherein said conformable material includes a blowing agent and comprises said resilient material after a working time.

17. The footwear insert according to claim 162, wherein said blowing agent is related from the group of physical and chemical blowing agents consisting of water, carbon dioxide, nitrogen, sodium bicarbonate, dinitrosopentabethylanetetramine, sulfonyl hydrazides, azodicarbonamide, p-toluenesulfonyl semicarbazide, 5-phenyltetrazole, diisopropylhydrezodicarboxylate, sodium borohydrite, and aliphatic hydrocarbons and their chloro- and fluoro- derivatives; isomers of pentans, hexane, heptane, fluorocarbons, trichlorofluoromethans, dichlorodifluoromethane, dichlorotstrafluoroethane, monochlorodifluororomethane, and methylene chloride.

18. The footwear insert according to claim 1, wherein said mixable reagents include at least one coloring agent to indicate proper mixing of said reagents.

19. The footwear insert according to claim 1, wherein said resilient material comprises an elastomeric material.

20. The footwear insert according to claim 19, wherein said elastomeric material is made from a material related from the group of polymers, copolymers, thermoplastics, and natural and synthetic rubbers consisting of silicone, silicone gel, urethane, polyurethane, polyethylene, polycarbonate, polyvinyl chloride, propylene, polyamide, latex, neoprene, nitrile, vinyl, nylon, polyester, butadiene acrylonitrile and styrene rubber, other natural and synthetic rubbers.

21. The footwear insert according to claim 1, wherein said pliable casing is made from a material related from the group of polymers, copolymers, thermoplastics, natural and synthetic rubbers consisting of silicone, urethane, polyurethane, polyester, polyethylene, polycarbonate, polyvinyl chloride, propylene, polyamide, latex, neoprene, nylon, vinyl, nitrile, butadiene acrylonitrile and styrene rubber, other natural and synthetic rubbers.

22. The footwear insert according to claim 1, wherein said footwear insert can be removably positioned in said article of footwear.

23. The footwear insert according to claim 1, further including a void formed within the inner volume of said footwear insert.

24. The footwear insert according to claim 23, wherein said void is substantially filled with a gas.

25. The footwear insert according to claim 24, wherein said void is at least partially encapsulated by said resilient material.

26. The footwear insert according to claim 1, further including a static mixing structure positioned between said reservoir of said appendage and said chamber.

27. A method for making a footwear insert for use in an article of footwear and conforming to and supporting a portion of a wearer's anatomy and attenuating force applications and shock, comprising:

a) selecting an article of footwear substantially containing and underlying said wearer's foot;
b) selecting a pliable casing forming a chamber having inner volume;
c) placing a foam material comprised of solid matter having select form generally conforming to said portion of said wearer's anatomy within said chamber;
d) providing a restraint to selectively separate the inner volume of said chamber into first and second portions so that said first and second portions are not in fluid communication with each other;
e) placing a first reagent into said first portion;
f) placing a second reagent into said second portion;
g) placing said first and second portions in fluid communication to thereby allow said reagents to mix to form a conformable material and at least partially encapsulate said foam material, said conformable material being selected to comprise a resilient material substantially comprising solid matter after a working time;
h) positioning said footwear insert in said article of footwear and inserting and securing said wearer's foot within said article of footwear thereby causing a force application to be made upon said footwear insert and causing at least a portion of said footwear insert to be formed in substantial conformance with said portion of the wearer's anatomy;
i) providing sufficient working time for said resilient material to substantially comprise solid matter, said footwear insert thereby exhibiting different select mechanical properties between at least two select portions of said footwear insert as the result of the coordinated and selected use of said foam material and said resilient material, said footwear insert substantially retaining the configuration imparted to said footwear insert when said resilient material substantially comprises solid matter.

28. The method according to claim 27, wherein said portion of said wearer's anatomy comprises said wearer's foot.

29. The method according to claim 27, wherein said portion of said wearer's anatomy comprises said wearer's lower leg.

30. The method according to claim 27, wherein said portion of said wearer's anatomy comprises said wearer's malleolus.

31. The method according to claim 27, further including a void substantially filled with a gas within said footwear insert.

32. The method according to claim 27, further including a static mixing structure within said footwear insert.

33. The method according to claim 27, wherein said restraint comprises a removable clamping mechanism.

34. The method according to claim 27, wherein said restraint comprises a breakable enclosure.

35. A footwear insert for use in an article of footwear and conforming to and supporting a portion of a wearer's anatomy and attenuating force applications and shock comprising a pliable casing forming a chamber having inner volume, said chamber containing mixable reagents and a foam material comprising solid matter having select form and generally conforming to said portion of said wearer's anatomy, a restraint for selectively isolating said chamber into two portions thereby selectively separating mixable reagents which can be made to mix to form a conformable material substantially comprised of fluid matter when said restraint is removed, said conformable material thereby at least partially encapsulating said foam material within said chamber, said conformable material forming a resilient material substantially comprising solid matter after a working time, said footwear insert exhibiting different select mechanical properties as between at least two portions thereof as the result of the coordinated and select use of said foam material and said resilient material, said footwear insert substantially retaining the shape imparted by said portion of said wearer's anatomy when said conformable material substantially comprises said resilient material.

36. A footwear insert for use in an article of footwear and conforming to and supporting a portion of a wearer's anatomy and attenuating force applications and shock comprising a pliable casing forming a chamber and an appendage, each having inner volume, said chamber containing mixable reagents and a foam material comprising solid matter having select form and generally conforming to said portion of said wearer's anatomy, a restraint for selectively isolating said chamber from said appendage thereby selectively separating mixable reagents which can be made to mix to form a conformable material substantially comprised of fluid matter when said restraint is removed, said conformable material thereby at least partially encapsulating said foam material within said chamber, said conformable material forming a resilient material substantially comprising solid matter after a working time, said footwear insert exhibiting different select mechanical properties as between at least two portions thereof as the result of the coordinated and select use of said foam material and said resilient material, said footwear insert substantially retaining the shape imparted by said portion of said wearer's anatomy when said conformable material substantially comprises said resilient material.

* * * * *

UNITED STATES PATENT AND TRADEMARK OFFICE

CERTIFICATE OF CORRECTION

PATENT NO. : 5,101,580

DATED : 4-7-92

INVENTOR(S) : Robert M. Lyden

It is certified that error appears in the above-indentified patent and that said Letters Patent is hereby corrected as shown below:

On the title page, within the thirteenth line of the ABSTRACT, change "(34)" to --(34)--.

Column 1, line 68: After the word "footwear" insert --.--.

Column 2, line 3: After the word "footwear" insert --.--.

Column 2, line 34: After the word "problems" insert --.--.

Column 2, line 41: After the word "footwear" insert --.--.

Column 4, line 13: Change "into," to --into--.

Column 4, line 44: Delete "catalyzed".

Column 5, line 17: After the word "contents" insert --.--.

Column 5, line 18: Change "20" to --20a--.

Column 5, line 35: Delete "20".

Column 5, line 35: After the word "ankles" insert --29--.

Column 5, line 38: After the word "the" insert --present invention--.

Column 5, line 42: Delete "29".

Column 5, line 49: Change "or." to --or--.

UNITED STATES PATENT AND TRADEMARK OFFICE

CERTIFICATE OF CORRECTION

PATENT NO. : 5,101,580

DATED : 4-7-92

INVENTOR(S) : Robert M. Lyden

It is certified that error appears in the above-indentified patent and that said Letters Patent is hereby corrected as shown below:

Column 6, line 3: Change "A" to --a--.

Column 6, line 67: Change "conforming," to --conforming and--.

Column 7, line 15: After "pins 24," insert --or--.

Column 7, line 34: Change "FIGS. 18 and 19." to --FIGS. 5, 7, and 8.--.

Column 7, line 39: Change "48 as" to --48. As--.

Column 7, line 44: Change "Fig. 19a" to Fig. 18, a--.

Column 7, line 57: Delete "20". Line 58 should follow in continuity directly.

Column 7, line 65: Change "20" to --20h--.

Column 7, line 66: Change "20)," to --17),--.

Column 8, line 15: After "activated," insert --and insert 20a is--.

Column 8, line 26: Change "20" to --20a--.

Column 8, line 44: Change "20" to --20a--.

Column 8, line 49: Change "adjacent," to --adjacent--.

Column 8, line 54, Change "stabilize," to --stabilize--.

Column 9, line 49: Change "20b" to --20c--.

UNITED STATES PATENT AND TRADEMARK OFFICE

CERTIFICATE OF CORRECTION

PATENT NO. : 5,101,580
DATED : 4-7-92
INVENTOR(S) : Robert M. Lyden

It is certified that error appears in the above-indentified patent and that said Letters Patent is hereby corrected as shown below:

Column 10, line 12: Change "20a" to --20c---.

Column 10, line 22: Change "of the" to --of insert 20d is shown in FIG. 13. The--.

Column 10, line 33: Change "20c" to --20e--.

Column 10, line 46: Change "44" to --41--.

Column 10, line 48: Change "forming" to --of--.

Column 10, line 66: Change "insert 66," to --foam material 66--.

Column 11, lines 1-2: Change "form insert 66" to --foam material 66--.

Column 11, line 2: Change "if" to --of--.

Column 11, line 3: Change "used and, " to --used, and--.

Column 11, line 21: Change "liquids,.or" to --liquids, or--.

Column 11, line 51: Change "20" to --20a--.

Column 11, line 63: Change "20" to --20a--.

Column 12, line 1: Change "of the preferred insert 20 to" to --to the preferred insert 20 and--.

Column 12, line 5: Change "20" to --20a--.

Column 12, line 13: Change "surface" to --surfaces--.

UNITED STATES PATENT AND TRADEMARK OFFICE

CERTIFICATE OF CORRECTION

PATENT NO. : 5,101,580
DATED : 4-7-92
INVENTOR(S) : Robert M. Lyden

It is certified that error appears in the above-indentified patent and that said Letters Patent is hereby corrected as shown below:

Column 12, line 13: Change "ports on" to --posts or--.

Column 12, line 14: Change "40" to --42--.

Column 12, line 31: Delete "20".

Column 12, line 49: Change "is" to --can--.

Column 12, line 54: Change "20a" to --20b--.

Column 12, line 57: Change "the material 41" to --the resilient material 41--.

Column 12, line 59: Change "reagents 64," to --reagents 27,--.

Column 13, line 13: Change "20." to --20c.--.

Column 13, line 14: Change "20" to --20c--.

Column 15, line 23, i.e., the sixth line of Claim 1: After the word "reagents" insert --,--.

Column 15, line 61: Change "mellaolus" to --malleolus--.

Column 16, line 4: Change "whereins" to --wherein--.

Column 16, line 5: Change "aid" to --said--.

Column 16, line 34: After the word "comprised" change "or" to --of--.

Column 16, line 36: After the word "chloride" delete ",".

UNITED STATES PATENT AND TRADEMARK OFFICE

CERTIFICATE OF CORRECTION

PATENT NO. : 5,101,580

DATED : 4-7-92

INVENTOR(S) : Robert M. Lyden

It is certified that error appears in the above-indentified patent and that said Letters Patent is hereby corrected as shown below:

Column 16, line 37: Change "borosilicets" to --borosilicate--.

Column 16, line 38: Change "brosilicate" to --borosilicate--.

Column 16, line 38: Change "perlite" to --perlite--.

Column 16, line 43, i.e., the first line of Claim 17: Change the number "162" to --16--.

Column 16, line 47 (Please also note that the line numbering is off with respect to columns 15 and 16.), i.e., the error occurs in the fifth line of Claim 17: Change the word "dinitrosopentabethylanetetramine" which has two incorrect characters to --dinitrosopentamethylanetetramine--.

Column 16, line 49, i.e., the seventh line of Claim 17: Change the word "diisopropylhydrezodicarboxylate" which has one incorrect character to --diisopropylhydrazodicarboxylate--.

Column 16, line 51, i.e., the ninth line of Claim 17: Change the word "pentans" to --pentane--.

Column 16, line 53, i.e., the eleventh line of Claim 17: Change "thans," to --thane,--.

Column 16, line 53, i.e., the eleventh line of Claim 17: Change "dichlorotstrafluoroe-" which has one incorrect character to --dichlorotetrafluoroe- --.

Column 17, line 9: The first word of this line, i.e., "late?", should read --latex--.

UNITED STATES PATENT AND TRADEMARK OFFICE

CERTIFICATE OF CORRECTION

PATENT NO. : 5,101,580

DATED : 4-7-92

INVENTOR(S) : Robert M. Lyden

It is certified that error appears in the above-indentified patent and that said Letters Patent is hereby corrected as shown below:

Column 18, line 24, i.e., the sixth line of Claim 35: After the word "reagents" insert --,--.

Column 18, line 48, i.e., the sixth line of Claim 36: After the word "reagents" insert --,--.

Signed and Sealed this

Twenty-second Day of February, 1994

Bruce Lehman

*Attest:*

BRUCE LEHMAN

*Attesting Officer*

*Commissioner of Patents and Trademarks*